US006062056A

United States Patent [19]

Groch

[11] Patent Number: 6,062,056

[45] Date of Patent: May 16, 2000

[54] METHOD AND APPARATUS FOR COOLING A STEEL STRIP

[75] Inventor: Andrzej G. Groch, Natrona Heights, Pa.

[73] Assignee: Tippins Incorporated, Pittsburgh, Pa.

[21] Appl. No.: 09/250,599

[22] Filed: Feb. 16, 1999

Related U.S. Application Data

[60] Provisional application No. 60/075,094, Feb. 18, 1998.

[51] Int. Cl.[7] ..... B21B 27/06

[52] U.S. Cl. ..... 72/201

[58] Field of Search ..... 72/200, 201, 202, 72/39, 43; 239/548, 561, 566

[56] References Cited

U.S. PATENT DOCUMENTS

| | | | |
|---|---|---|---|
| 1,256,243 | 2/1918 | Maul | 239/566 |
| 1,485,495 | 3/1924 | Eldred et al. | 239/566 |
| 4,247,047 | 1/1981 | Schaming | 239/391 |
| 4,440,584 | 4/1984 | Takeshige et al. | 148/128 |
| 4,510,784 | 4/1985 | Hsu | 72/201 |
| 4,596,615 | 6/1986 | Matsuzaki et al. | 148/128 |
| 4,785,646 | 11/1988 | Uekaji et al. | 72/13 |
| 5,186,885 | 2/1993 | Perneczky | 266/115 |
| 5,212,975 | 5/1993 | Ginzburg | 72/43 |

*Primary Examiner*—Rodney A Butler
*Attorney, Agent, or Firm*—Webb Ziesenheim Logsdon Orkin & Hanson, P.C.

[57] ABSTRACT

A method and apparatus provide a uniform temperature distribution across the width of a metal strip during cooling. The apparatus includes a cooling pipe having nozzles attached thereto. The nozzles are constructed and arranged so that coolant flow is greatest near the center of the strip and smallest furthest from the center of the strip to provide a uniform temperature distribution in the cooled strip.

17 Claims, 5 Drawing Sheets

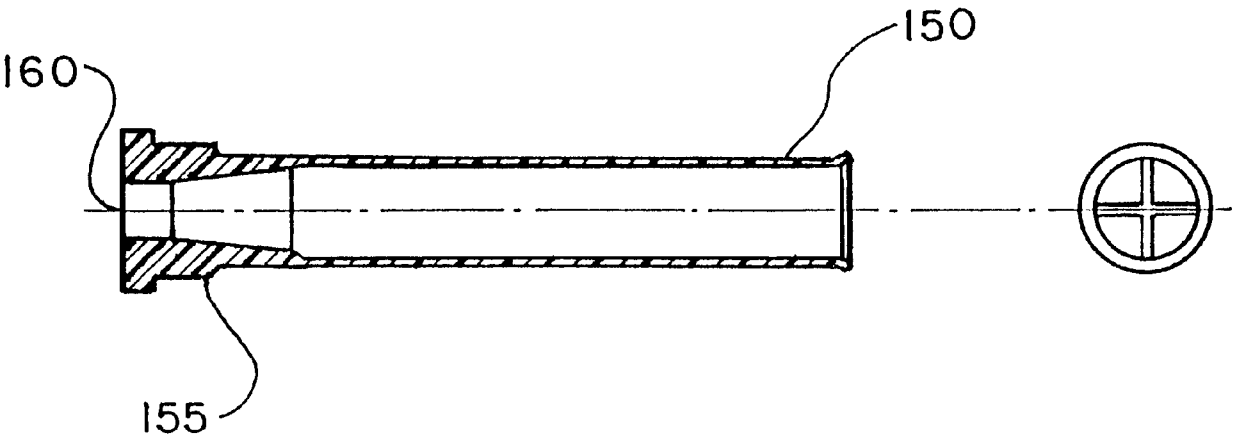
FIG. 7c
FIG. 7b
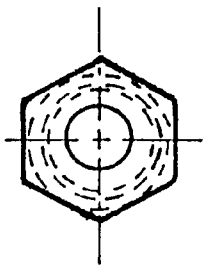
FIG. 7a

METHOD AND APPARATUS FOR COOLING A STEEL STRIP

CROSS REFERENCE TO RELATED APPLICATION

This application claims the benefit of earlier filed U.S. Provisional Patent Application Ser. No. 60/075,094, filed on Feb. 18, 1998, entitiled "Method and Apparatus for Cooling Steel Strip".

BACKGROUND OF THE INVENTION

1. Field of the Invention

This invention relates to a hot rolling mill through which a heated piece of metal, such as steel, is passed to produce a progressively thinned and elongated metal strip which is then cooled, and more particularly, to an apparatus and method for cooling the strip to provide a uniform temperature distribution across the width of the strip.

2. Background of the Prior Art

It is the conventional practice to heat and then cool a hot rolled metal strip, such as steel, during the rolling process for the purpose of controlling the hot rolling process and improving strength, toughness and other properties of the hot rolled steel strip. One step in the rolling process is the controlled cooling of the steel strip which is typically done using a laminar flow of coolant, such as water, dispersed upon the top and bottom sides of the strip. The edges of the strip tend to cool first and to a greater extent, thereby providing a nonuniform temperature distribution across the width of the strip. While a small difference in the temperature between the edge and the center of the strip may be tolerable, large temperature differences are not, because not only does this provide non-uniform mechanical properties to the strip but furthermore results in shape defects such as waviness from what otherwise should be a flat steel strip.

As used herein, the term "strip" is used to identify steel in coil form or plates which are being rolled on a plate mill either from discrete slabs or as a coil plate product.

FIG. 1 is prior art and illustrates a portion of a hot rolling mill 10 with a section view of a steel strip 15 horizontally supported by a roller 20 which is itself supported by a roller shaft 25 mounted to roller supports 30. The steel strip 15 travels along a series of rollers 20 forming a roller table in a direction of travel out of the page as indicated by arrow 35. A supply pipe 50 has branching from it a number of coolant pipes 55, each extending over the steel strip 15 in a direction generally perpendicular to the direction of travel 35 of the steel strip 15. Extending radially from the coolant pipe 55 and distributed along the length of the coolant pipe 55 is a plurality of nozzles 60 directed toward the steel strip 15 for distributing coolant across the width of the steel strip 15. The coolant generally drains from the center over the outer edges 75 of the steel strip 15 and therefore the quantity of water at the center 70 of the steel strip 15 is less than the quantity of water at the edges 75 of the steel strip 15. As a result, the increased quantity of coolant at the edges 75 has a greater capacity to absorb heat at the edges 75 than the lesser quantity of coolant at the center 70 of the steel strip 15. This in itself may promote a non-uniform cooling across the width of the steel strip 15. Even without the non-uniform coolant flow over the steel strip 15, the edges 75 of the steel strip 15 would still cool faster than the remainder of the strip 15 because the center 70 is warmed by the adjacent portions of the strip 15 while an edge 75 receives such warming only on the side of the edge 75 toward the center 70.

The temperature of the steel strip as it exits the hot rolling mill is about 1500–1700° F. After cooling, a temperature difference from the center of the strip to the edge of approximately 30° F. is acceptable and is considered to represent a uniform temperature distribution. However, temperatures greater than that difference tend to excessively modify the metallurgical properties of the steel and also tend to promote waviness of the edges 75 of the strip 15.

Current cooling techniques involve utilizing a plurality of nozzles 60 across the length of the coolant pipe 55, each with the same inner diameter. This provides an acceptable temperature distribution for steel strip 15 having a width of 80 inches or less. FIG. 2 shows the temperature profile for an 80-inch section of the steel strip 15 indicated by letters B and C in FIG. 1.

The greatest temperature differences between the center 70 and the edges 75 occur very close to the edge 75. For typical plate product in which the strip is greater than 80 inches wide, such as, for example, 120 inches wide plate as illustrated by points A and D in FIGS. 1 and 2, the temperature difference in the edge region of the steel strip 15 is drastically different. This difference is unacceptable, and an apparatus and method to provide a more uniform cooling rate across the width of the steel strip 15 is desired.

FIG. 3 illustrates details of Section III—III shown in FIG. 1 wherein the supply pipe 50 provides to the coolant pipe 55 coolant which is disseminated through nozzles 60. Each of the nozzles 60 is equally spaced and furthermore all of the nozzles have the same internal diameter.

An object of this invention is to provide a method and apparatus which may be utilized to provide a uniform temperature distribution across the width of a steel strip during cooling upon exiting from a hot strip mill.

SUMMARY OF THE INVENTION

The above objects are achieved with a coolant distribution apparatus according to the present invention which is hereinafter described for uniformly cooling the top surface of a horizontally supported hot rolled metal strip, such as steel, traveling in a direction along the length of a hot rolling mill, such as a hot reversing Steckel mill. The apparatus will include a coolant supply above the metal strip for supplying coolant fluid to the top surface of the metal strip, and a coolant distribution system coupled to the coolant supply for distributing coolant fluid to the top surface of the metal strip across a width of the metal strip in which the flow is greatest nearest to a center of the metal strip and smallest furthest from the center of the metal strip, with flow therebetween progressively less from points closest to the center of the metal strip to points furthest from the center of the metal strip.

One embodiment of the invention includes a coolant pipe with a plurality of orifices extending therethrough. The coolant pipe may be mounted horizontally above the metal strip and extends perpendicular to the direction of travel of the metal strip for distributing of a coolant fluid to the top surface of the metal strip. A plurality of nozzles, each nozzle having an internal diameter, may be positioned adjacent a corresponding coolant pipe orifice. The nozzles extend along the length of the coolant pipe, are directed toward the top surface of the metal strip and may be located symmetrically about a center of the metal strip.

In one embodiment, the internal diameter of the nozzles or group of nozzles nearest the center of the metal strip are the largest, while the internal diameter of the nozzles furthest from the center of the metal strip are the smallest. The internal diameters of the nozzles therebetween progressively decrease with distance away from the center of the metal strip. In one embodiment, the spacing between adjacent nozzles nearest the center of the metal strip are the smallest and the spacing between adjacent nozzles farthest from the center of the metal strip are the largest.

Additionally, a method is hereinafter described for cooling the top surface of a horizontally supported hot rolled metal strip, such as steel, traveling in a direction along a hot rolling mill comprising the step of providing coolant flow across a width of the metal strip in which the flow is greatest nearest to the center of the metal strip and smallest furthest from the center of the metal strip with flow therebetween progressively less from points closest to the center of the metal strip to points furthest from the center of the metal strip.

These and other advantages of the present invention will be clarified with the description of the preferred embodiments taken together with the attached figures wherein like reference numerals represent like elements throughout.

BRIEF DESCRIPTION OF THE DRAWINGS

FIGS. 7*a*, 7*b* and 7*c* show the top, cross sectional side, and rear view of a typical nozzle.

DETAILED DESCRIPTION OF THE PREFERRED EMBODIMENTS

Figure 1:
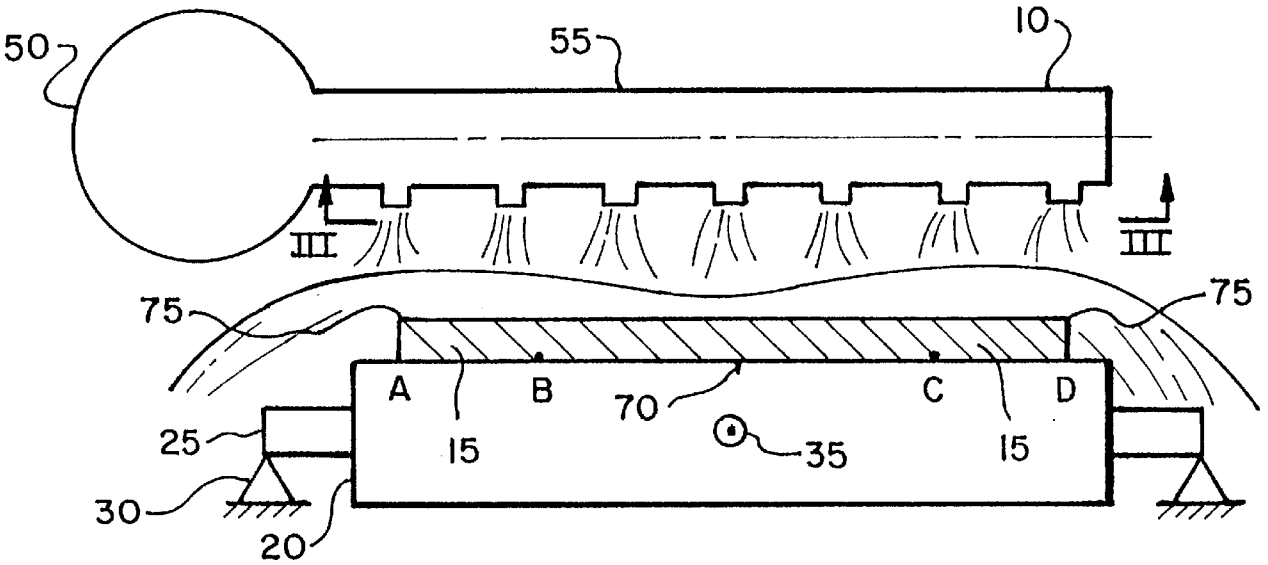
FIG. 1 (PRIOR ART)
FIG. 1 is a sketch illustrating a cross section of a portion of a typical strip rolling mill using a coolant pipe with spaced nozzles.
Figure 2:
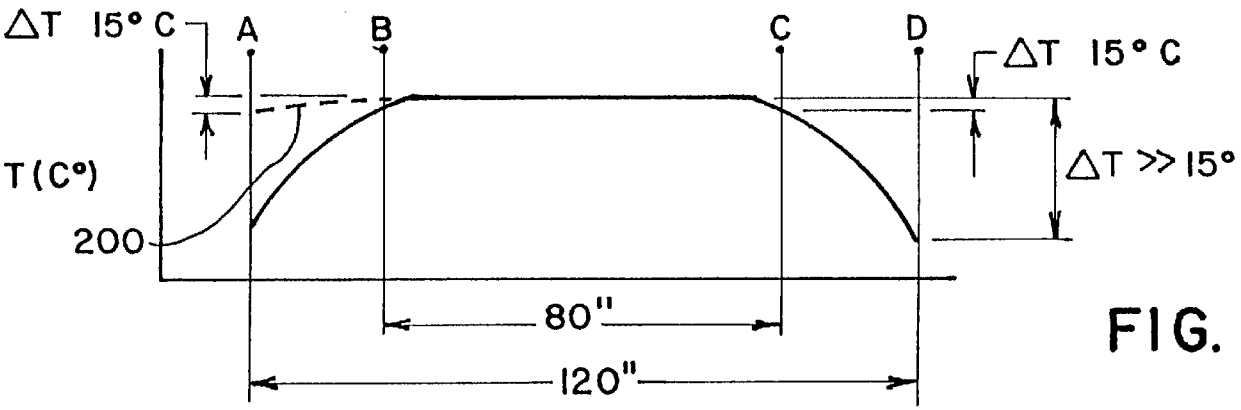
FIG. 2 is a drawing illustrating an example of an average temperature distribution in the width direction immediately after the completion of cooling using current techniques.
Figure 3:
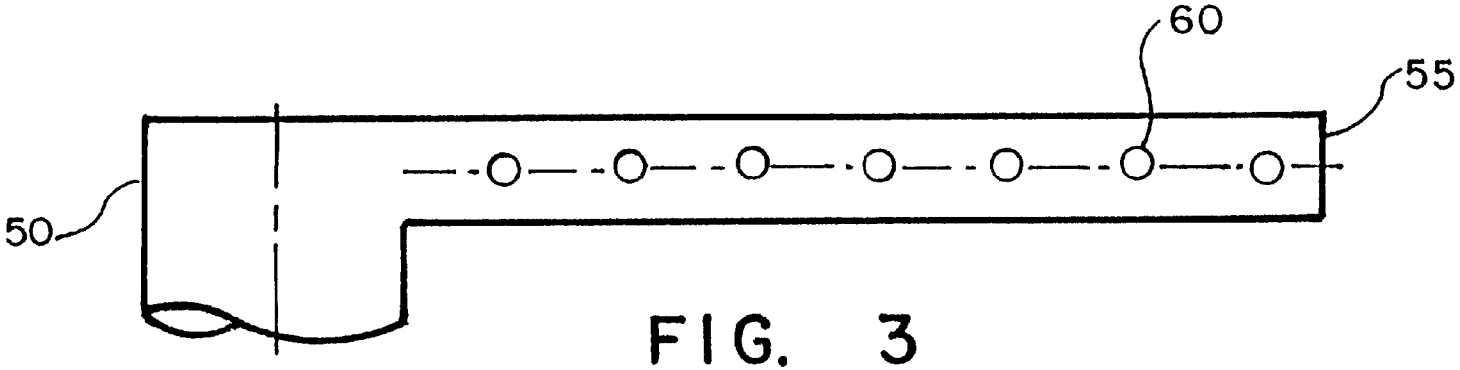
FIG. 3 (PRIOR ART)
FIG. 3 is a view along arrows III—III in FIG. 1 showing the prior art arrangement of the nozzles in the coolant pipe.
Figure 4:
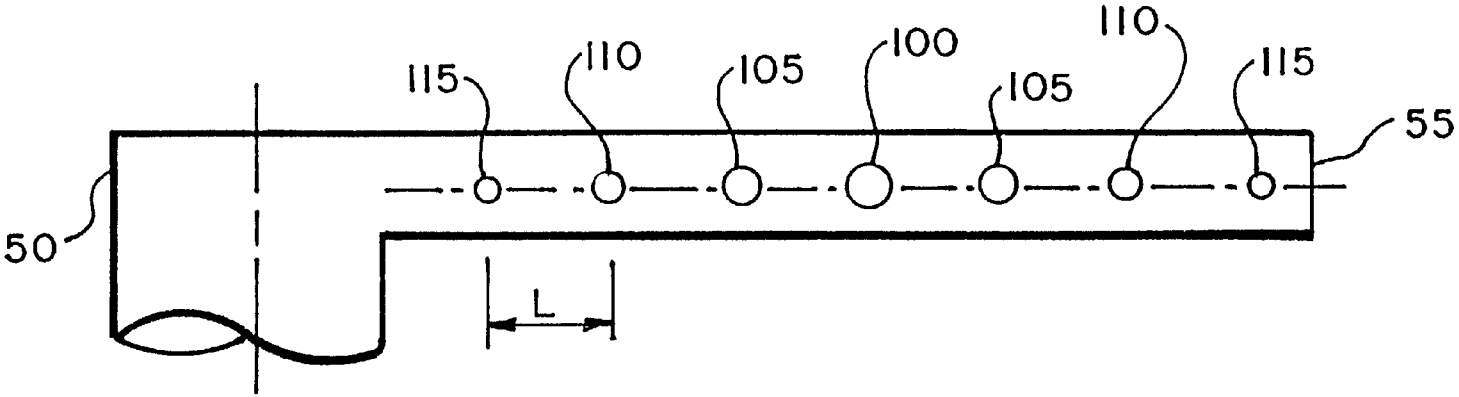
FIG. 4 is a configuration of nozzles along the coolant pipe in accordance with a first embodiment of the present invention.

It is necessary to modify the quantity of water flowing over the metal or steel strip 15 in order to provide greater uniformity in the cooling rate along the steel strip 15 for steel strip 15 having a width greater than 80 inches. In other words, it is necessary to reduce the temperature difference between points A and B and C and D in FIG. 2 to a number within the acceptable range of 30° F. If the coolant flow from the coolant pipe 55 at the nozzles 60 closer to the edge of the steel strip 15 provides a reduced coolant flow, then the quantity of coolant over the steel strip 15 may be more uniform. More specifically, the subsequent heat transfer across the steel strip 15 may be more uniform. To that end, FIG. 4 illustrates a supply pipe 50 with a coolant pipe 55 attached thereto. Nozzles 100, 105, 110, 115 extend across the width of the coolant pipe 55. The nozzle 100 closest to the center 70 of the steel strip 15 has the largest inner diameter, and the inner diameter of the nozzles 105, 110 and 115 become progressively smaller with distance from the center 70 of the steel strip 15. In such a fashion, the profile of the water distribution over the steel strip is believed to be changed such that the quantity of water flowing at the edges of the steel strip 15 is closer in volume to the quantity of water flowing over the center 70 of the steel strip 15.

Returning to FIG. 2, it is believed that such an arrangement will result in a temperature profile more closely aligned with that illustrated by dotted line 200 between points A and B. While not illustrated, it should be realized that such a profile would also be available between points C and D.

The nozzles illustrated in FIG. 4 are symmetric in distance from the center 70 of the steel strip 15 and the internal diameters of the nozzles are also symmetric about the center 70 of the steel strip 15. Specifically, nozzles 105 on both sides of the center are identical, just as are nozzles 110 and 115 with one another. While nozzles 100, 105, 110 and 115 are illustrated as equally spaced along the cooling pipe by a distance L, this is not necessary, and just as the inner diameter of each of these nozzles is different, so, too, may be the spacing between the nozzles as illustrated in FIG. 5 by nozzles 120, 125, 130, 135 spaced apart by distances L1, L2 and L3.

Figure 5:
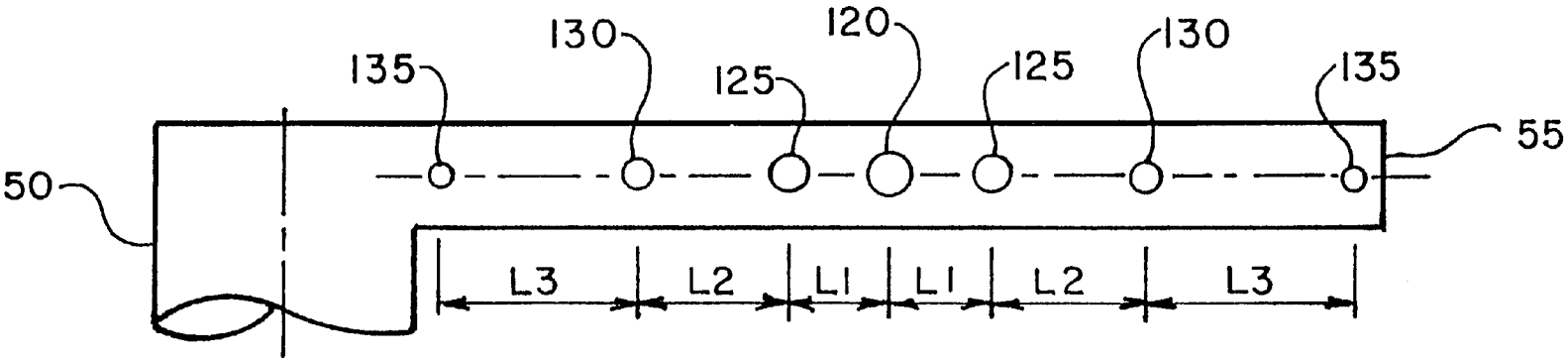
FIG. 5 is a configuration of nozzles along the coolant pipe in accordance with a second embodiment of the present invention.

While FIG. 5 illustrates nozzles having different inner diameters spaced apart by distances L1, L2 and L3, it is also possible to provide nozzles having the same inner diameter but spaced apart in a similar fashion. Specifically, the distance between nozzles would increase from the center to the edges of the steel strip.

Figure 6:
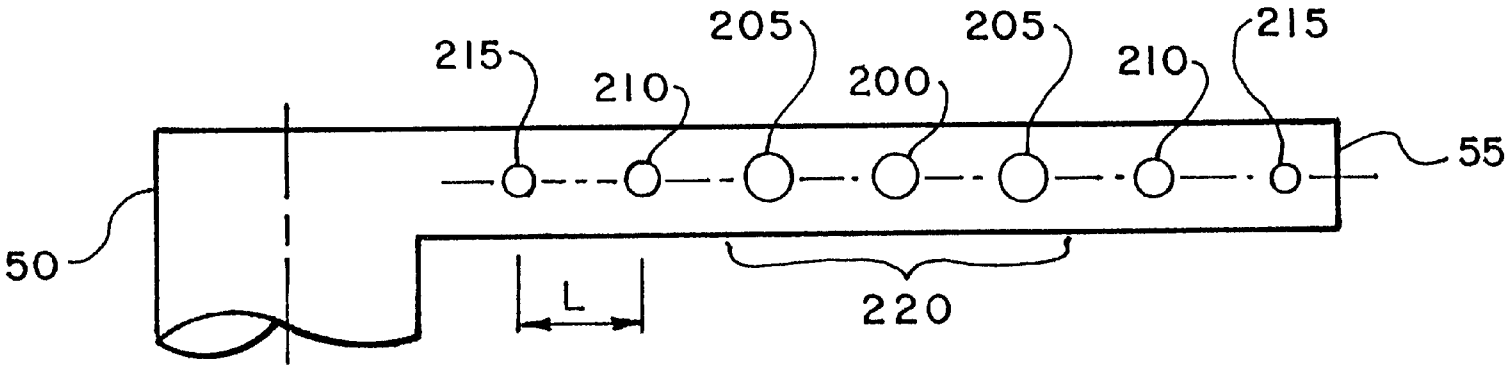
FIG. 6 is a configuration of nozzles along the coolant pipe in accordance with a third embodiment of the present invention.

FIG. 4 illustrates a series of nozzles spaced equally along the length of the coolant pipe 55 in which the center nozzle 100 has the largest diameter and the adjacent nozzles 105 have smaller diameters. As illustrated in FIG. 6, it is possible that a plurality of nozzles 200, 205 clustered about the center of coolant pipe 55 have equal diameters and the nozzles 210, 215 adjacent this cluster 220 have diameters of descending size as the nozzles are located further from the center of the coolant pipe 55. All of the nozzles across the coolant pipe 55 may be spaced equally by a distance L, as illustrated in FIG. 6, or, in the alternative, may be spaced symmetrically but with different distances between adjacent nozzles in a fashion similar to that illustrated in FIG. 5.

Furthermore, whatever the configuration of nozzles on either side of the cluster 220, it is possible to vary the distance between nozzles within the cluster 220 in a fashion similar to that illustrated by the nozzles in FIG. 5.

Figure 8:
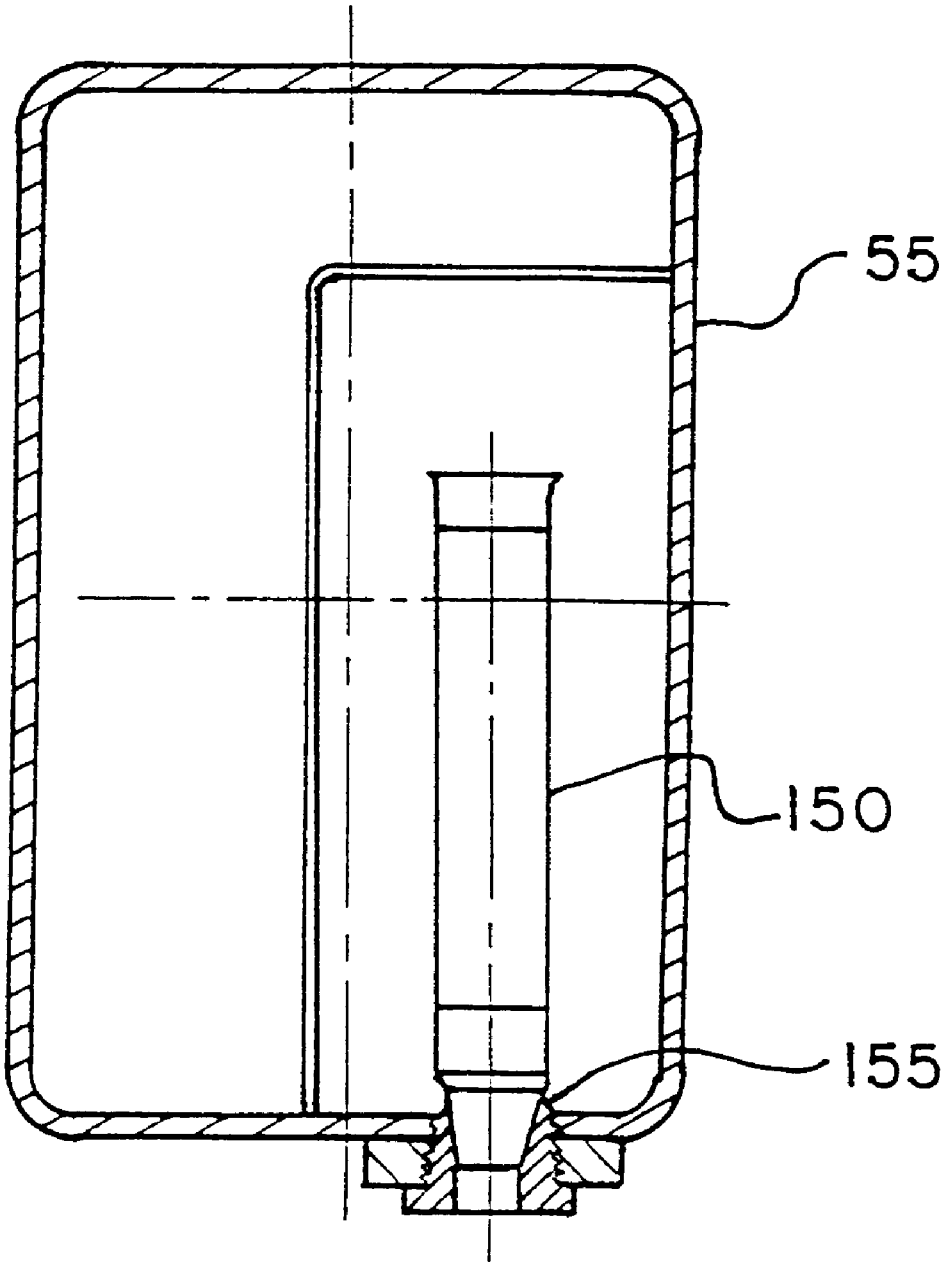
FIG. 8 illustrates a cross sectional side view of a coolant pipe with a typical nozzle mounted therein.

FIGS. 7*a*, 7*b* and 7*c* illustrate a front view, cross sectional view and rear view of a typical nozzle 150 that may be used as any of the nozzles presented in FIGS. 4–6. The difference in each of these nozzles, as indicated, would be the internal diameter. FIG. 8 illustrates a cross sectional view of one embodiment of the coolant pipe 55 with the nozzle 150 mounted therein. While the coolant pipe 55 in this embodiment has a rectangular cross section, it is entirely possible for the coolant pipe 55 to have a circular cross section.

For ease in removing and installing nozzle 150, the nozzle body is preferably made of plastic, metal, or other suitable material and is secured to the coolant pipe 55 with a threaded portion 155 which mates with matching threads on an orifice extending through the coolant pipe 55. The internal diameter of the nozzle 150 may be made larger or smaller than the cooling pipe orifice 160 in order to accommodate the nozzles of varying diameter that will be positioned across the length of the coolant pipe 55 and still retain the same exterior dimensions on the nozzle 150, thereby permitting use of the same orifices 160 extending through the coolant pipe 55.

While FIGS. 4, 5 and 6 illustrate schematics showing only seven nozzles, it should be appreciated for commercial applications, nozzles generally are distributed every 2–3 inches and therefore a coolant pipe having a length of 120 inches would, in actuality, have many more nozzles.

This discussion has been directed toward an apparatus and a method for cooling the top surface of the steel strip 15. It is also important to provide uniform cooling to the bottom surface of the steel strip 15. However, the mechanisms employed are significantly different and are not the subject matter of this disclosure nor the focus of the subject invention.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A coolant distribution apparatus for uniformly cooling a top surface of a hot rolled metal strip, the coolant distribution apparatus comprising:

(a) a coolant pipe mounted above and extending across the metal strip for distributing a coolant fluid to the top surface of the metal strip, the coolant pipe having a plurality of orifices; and (b) a plurality of nozzles positioned along the length of the coolant pipe symmetrically about a center of the metal strip, each nozzle positioned adjacent a corresponding coolant pipe orifice and directed toward the top surface of the metal strip, each nozzle having an internal diameter wherein the internal diameter of the nozzles nearest the center of the metal strip are the largest and the internal diameter of the nozzles furthest from the center of the metal strip are the smallest.

2. The coolant pipe as claimed in claim 1 wherein the orifices extending through the coolant pipe are threaded.

3. The coolant distribution apparatus as claimed in claim 1 wherein the coolant pipe has a rectangular cross section.

4. The coolant distribution apparatus as claimed in claim 1 wherein the internal diameters of the nozzles are symmetric about the center of the metal strip.

5. The coolant distribution apparatus as claimed in claim 1 wherein the nozzles are equally spaced along the coolant pipe.

6. The coolant distribution apparatus as claimed in claim 1 wherein the internal diameters of the nozzles progressively decrease with distance away from the center of the metal strip.

7. The coolant distribution apparatus as claimed in claim 1 wherein the internal diameter of each nozzle is larger than the cooling pipe orifice.

8. The coolant distribution apparatus as claimed in claim 1 wherein the internal diameter of each nozzle is smaller than the cooling pipe orifice.

9. The coolant distribution apparatus as claimed in claim 1 wherein the nozzle has a threaded portion.

10. The coolant distribution apparatus as claimed in claim 6 wherein the nozzles are equally spaced along the coolant pipe.

11. A coolant distribution apparatus for uniformly cooling a top surface of a hot rolled metal strip, the coolant distribution apparatus comprising:

(a) a coolant pipe mounted above and extending across the metal strip for distributing a coolant fluid to the top surface of the metal strip, the coolant pipe having a plurality of orifices; and (b) a plurality of nozzles positioned along the length of the coolant pipe symmetrically about a center of the metal strip, each nozzle positioned adjacent a corresponding coolant pipe orifice and directed toward the top surface of the metal strip, wherein the spacing between adjacent nozzles nearest the center of the metal strip is the smallest and the spacing between adjacent nozzles furthest from the center of the metal strip is the largest.

12. The coolant distribution apparatus as claimed in claim 11 wherein each nozzle has an internal diameter and the internal diameter of the nozzles nearest the center of the metal strip are the largest and the internal diameter of the nozzles furthest from the center of the metal strip are the smallest.

13. The coolant distribution apparatus as claimed in claim 12 wherein the internal diameters of the nozzles progressively decrease with distance away from the center of the metal strip.

14. A coolant distribution apparatus for cooling the top surface of a hot rolled metal strip traveling in a direction along a hot rolling mill comprising:

A coolant supply means above the metal strip for supplying coolant fluid to the top surface of the metal strip; and coolant distribution means coupled to the coolant supply means for distributing coolant fluid to the top surface of the metal strip across a width of the metal strip in which the flow is greatest nearest to a center of the metal strip and smallest furthest from the center of the metal strip, with flow therebetween progressively less from points closest to the center of the metal strip to points furthest from the center of the metal strip.

15. A method for cooling the top surface of a hot rolled metal strip traveling in a direction along a hot rolling mill comprising the step of providing coolant flow across a width of the metal strip in which the flow is greatest nearest to a center of the metal strip and smallest furthest from the center of the metal strip, with flow therebetween progressively less from points closest to the center of the metal strip to points furthest from the center of the metal strip.

16. The method for cooling metal strip as claimed in claim 15 wherein the coolant is water.

17. The method for cooling metal strip as claimed in claim 15 wherein the metal strip is steel.

* * * * *